US006453860B1

(12) United States Patent
Hase

(10) Patent No.: US 6,453,860 B1
(45) Date of Patent: Sep. 24, 2002

(54) VALVE TIMING CONTROL DEVICE

(75) Inventor: Hirofumi Hase, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/947,437

(22) Filed: Sep. 7, 2001

(30) Foreign Application Priority Data

Mar. 5, 2001 (JP) ..... 2001-060770

(51) Int. Cl.[7] ..... F01L 1/34
(52) U.S. Cl. ..... 123/90.17
(58) Field of Search ..... 123/90.15, 90.17, 123/90.31

(56) References Cited

U.S. PATENT DOCUMENTS 5,738,056 A * 4/1998 Mikame et al. ..... 123/90.17
6,062,182 A * 5/2000 Ogawa ..... 123/90.17
6,311,655 B1 * 11/2001 Simpson et al. ..... 123/90.17
6,386,164 B1 * 5/2002 Mikame et al. ..... 123/90.17

FOREIGN PATENT DOCUMENTS

| | | |
|---|---|---|
| JP | 10-159514 | 6/1998 |
| JP | 10-159519 | 6/1998 |
| JP | 10-159520 | 6/1998 |

* cited by examiner

*Primary Examiner*—Weilun Lo
(74) *Attorney, Agent, or Firm*—Sughrue Mion, PLLC

(57) ABSTRACT

A valve timing control device includes a lock member and a push member. The lock member locks a rotor in relation to a case at an approximately intermediate position apart from both of the maximum advanced side position and the maximum retarded side position. At all times, the push member pushes the lock member in a direction of fitting the lock member in the fitting hole arranged at any one hand of the rotor or the case. A release hydraulic pressure for releasing the fitting state of the lock member in the fitting hole against the push force of the push member is set to be higher than a lock hydraulic pressure for allowing the fitting state of the lock member in the fitting hole.

9 Claims, 10 Drawing Sheets

VALVE TIMING CONTROL DEVICE

BACKGROUND OF THE INVENTION

1. Field of the Invention

The present invention relates to a valve timing control device for modifying the opening and closing timing of an intake valve or an exhaust valve making contact with cams fixed on an intake camshaft or an exhaust camshaft of an internal-combustion engine (hereafter, referred as an engine).

2. Description of the Prior Art

Various types of solutions have been proposed for conventional valve timing control devices. The majority of the proposition includes a housing of rotating in synchronization with a driving force transmitting means transmitting a driving force from a crankshaft of the engine to an intake camshaft and an exhaust camshaft, a case fixed on the housing and having a plurality of shoes which are projected inwardly to form a plurality of hydraulic pressure chambers, and a rotor fixed on an end of the intake camshaft or the exhaust camshaft and having a plurality of vanes to divide the hydraulic pressure chambers into advance side hydraulic pressure chambers and retardation side hydraulic pressure chambers, for example. A hydraulic pressure is provided to and discharged from the advance side hydraulic pressure chamber and the retardation side hydraulic pressure chamber due to an oil control valve. (hereafter, referred as OCV) and the rotor rotates relatively at a required angle with respect to the case. In this way, it is possible to variably control the phase of the intake camshaft or the exhaust camshaft and to modify the opening and closing timing of the intake valve and the exhaust valve as appropriate according to any operation conditions.

Most of the conventional valve timing control devices have a lock mechanism for locking the rotor, which is fixed on an end of the camshaft, in relation to the case rotating in synchronism with the crankshaft at a reference position on starting the engine. The lock mechanism includes a fitting hole arranged at any one hand of the rotor or the case, a lock member arranged at the other hand and fit in the fitting hole to lock the rotor in relation to the case at any one of the maximum advanced side and the maximum retarded side positions, and a push member of pushing the lock member in a direction of fitting the lock member in the fitting hole at all times. With the conventional construction, the initial operation direction of the rotor was limited to only retardation direction or only advance direction.

However, if it is possible to operate the rotor of the valve timing control device from the reference position (hereafter, referred also as a lock position) on starting the engine toward the advance side and the retardation side without the limitation of only one direction such as the retardation direction or the advance direction, it is a foregone conclusion that such a device will have improved versatility.

An intermediate position lock type of the valve timing control device is therefore proposed. With the device, the lock position is set to an approximately intermediate position apart from both of the maximum advanced side position and the maximum retarded side position. It is possible to operate the rotor from the lock position to the advance side and the retardation side.

However, the intermediate position lock type of the valve timing control device has typical problems derived from the typical construction, which is different from the conventional valve timing control devices such as the maximum advanced side position lock type or the maximum retarded side position lock type.

First, with the maximum advanced side position lock type or the maximum retarded side position lock type of the valve timing control device, when the lock member is able to fit in the fitting hole, a hydraulic pressure is applied on the rotor to press the rotor toward the lock position. Here, contact of one of the vanes of the rotor is ensured with one of shoes of the case at the maximum advanced side position or the maximum retarded side position. Therefore, since no force is applied on the lock member, the lock member does not catch on with the other parts. Further, with the conventional valve timing control device, even if a hydraulic pressure in the device is reduced when operation oil is consumed by operation of the device or when a hydraulic pressure passage in the OCV side becomes narrow in a hydraulic pressure supply mode of the OCV side (hereafter, referred as OCV intermediate retained mode) for keeping the rotor with respect to the case at the intermediate position on normal operation, the lock member does not fit or catch on or engage between the maximum advanced side position and the maximum retarded side position because the fitting hole is arranged at the maximum advanced side position or the maximum retarded side position. Since the lock member does not catch on or engage with the fitting hole, the valve timing control device is not disabled during normal operation or in an intermediate retained state.

On the other hand, with the intermediate position lock type of valve timing control device, the fitting hole is arranged at an approximately intermediate position apart from both of the maximum advanced side position and the maximum retarded side position. First, when the rotor is held with respect to the case at the about intermediate position due to the hydraulic pressure supplied from the OCV, the hydraulic pressure passage in the OCV side narrows when in the OCV intermediate retained mode. A hydraulic pressure in the advance side hydraulic pressure chamber or the retardation side hydraulic pressure chamber and a release hydraulic pressure chamber is therefore substantially reduced to one half of the hydraulic pressure in the OCV and the release hydraulic pressure is not sufficient. As a result, the lock member sometimes catches on in or fitted in the fitting hole. In this case, there is a problem that the lock member and the fitting hole undergo wear which reduces their durability, and that the valve timing control device becomes incapable of operation from the intermediate retained state.

Second, when the lock member is operated beyond the fitting hole as the intermediate lock position and the release hydraulic pressure is reduced associated with the reduction of the hydraulic pressure in the advance side hydraulic pressure chamber or the retardation side hydraulic pressure chamber which is generated by consuming the operating oil used for the operation of the device, the lock member pops up due to the pushing force of the pushing member under operation condition and catches on in the fitting hole to prevent operation.

SUMMARY OF THE INVENTION

Accordingly, it is an object of the present invention to provide a valve timing control device being a type of locking a rotor at a intermediate position defined between the maximum advanced side and the maximum retarded side with respect to a case, which can reliably control the operation of a lock member to resolve the problems described above.

In order to achieve the object of the present invention, a valve timing control device for modifying the opening and closing timing of an intake valve or an exhaust valve making contact with cams fixed on an intake camshaft or an exhaust camshaft of an internal-combustion engine, comprises a housing rotating in synchronization with a driving force transmitting means transmitting a driving force from a crankshaft of the internal-combustion engine to an intake camshaft and an exhaust camshaft; a case fixed on the housing and having a plurality of shoes which are projected inwardly to form a plurality of hydraulic pressure chambers; a rotor fixed on an end of the intake camshaft or the exhaust camshaft and having a plurality of vanes to divide the hydraulic pressure chambers into advance side hydraulic pressure chambers and retardation side hydraulic pressure chambers; a fitting hole arranged on one of the rotor or the case; a lock member arranged on the other of the rotor or the case and fit in the fitting hole to lock the rotor in relation to the case at an approximately intermediate position apart from both of the maximum advanced side position and the maximum retarded side position; and a push member normally biasing the lock member in a direction of fitting the lock member in the fitting hole, wherein a release hydraulic pressure for releasing the fitting state of the lock member in the fitting hole against the push force of the push member is set to be higher than a lock hydraulic pressure for allowing the fitting state of the lock member in the fitting hole. In this way, a load of the pushing member corresponding to the lock hydraulic pressure can be previously set to a low level. It can therefore reliably prevent an operational failure of the device even if a hydraulic pressure in the device is reduced by the OCV intermediate retained mode or even if the operation oil is consumed by operation of the device. The operational failure of the device generates when the lock member pops up from the fitting hole due to the pushing force of the pushing member to catch on or engage in the fitting hole.

The lock hydraulic pressure may be set to be nearly equal to or lower than a hydraulic pressure of generating a torque generated in the device, the torque being equal to a cam-torque during internal-combustion. In this way, even under a minimum hydraulic pressure condition such as high temperature oil or idle rotation for example, even in the intermediate retained state, it can obviate the inconvenience of fitting the lock member in the fitting hole or getting trapped therein. As a result, the operation of the lock member can be reliably controlled.

The present invention may further comprise first and second communication passages, wherein the first communication passage communicates a backward pressure chamber, in which the push member is arranged, to the advance side hydraulic pressure chamber or the retardation side hydraulic pressure chamber as an operational hydraulic pressure chamber of operating the device, and wherein the second communication passage communicates the backward pressure chamber to outside the device. In this way, since a backward pressure can be applied to the lock member in a releasing operation, the release hydraulic pressure can be set to be higher than the lock hydraulic pressure. Since the release operation can be also delayed, discharge of air remaining in each passage and each chamber in the VVT can be ensured through the first and second communication passages to the outside on starting the engine. As a result, release operations, which are not predetermined and result from residual air, can be reliably prevented.

The first communication passage may be formed at an end of the case in an axial direction of the case. In this way, it is possible to easily process the first communication passage. It is also possible to shorten the length in the minimum cross sectional area of the first communication passage to reduce passage resistance in the first communication passage. It is further possible to perform the release operation of the lock member with stability.

The first communication passage may be a branch of a hydraulic pressure supply passage of communicating the operational hydraulic pressure chamber to a release hydraulic pressure chamber. In this way, it is possible to easily process the first communication passage and to reduce passage resistance in the first communication passage.

The cross sectional area of the first communication passage may be set to be larger than that of the second communication passage. In this way, since the backward pressure can be surely applied to the backward pressure chamber, the release hydraulic pressure can be set to be higher than the lock hydraulic pressure.

The cross sectional area of the second communication passage may be set to be larger than that the cross sectional area allowing discharge of foreign materials. In this way, since foreign materials in drain oil can be surely discharged from the backward pressure chamber to the outside, it can prevent the second communication passage from being blocked by the foreign materials and can ensure reliable operation of the lock member.

The driving force transmitting means may be a chain, the lock member may move in a radial direction of the device, and a stopper may be arranged at the outermost section of the device, the stopper of holding the push member in the backward pressure chamber and integrated with the second communication passage. In this way, the backward pressure in the backward pressure chamber is drained directly to the outside without the passage resistance due to the passage length or diameter. A stable difference between the release hydraulic pressure and the lock hydraulic pressure can be predetermined even if air is mixed in oil in the hydraulic pressure chamber such as an advance side hydraulic pressure chamber.

A valve timing control device for modifying opening and closing timing of an intake valve or an exhaust valve making contact with cams fixed on an intake camshaft or an exhaust camshaft of an internal-combustion engine, may comprise a housing rotating in synchronization with a driving force transmitting means transmitting a driving force from a crankshaft of the internal-combustion engine to an intake camshaft and an exhaust camshaft; a case fixed on the housing and having a plurality of shoes which are projected inwardly to form a plurality of hydraulic pressure chambers; a rotor fixed on an end of the intake camshaft or the exhaust camshaft and having a plurality of vanes to divide the hydraulic pressure chambers into advance side hydraulic pressure chambers and retardation side hydraulic pressure chambers; a fitting hole arranged on one of the rotor or the case; a lock member arranged on the other of the rotor or the case and fit in the fitting hole to lock the rotor in relation to the case at an approximately intermediate position apart from both of the maximum advanced side position and the maximum retarded side position, the lock member including a head section fitting the fitting hole and a flange section having a diameter larger than the head section; a push member pushing the lock member in a direction fitting the lock member in the fitting hole at all times; and a seal member for stopping the flow of operational oil between the advance side hydraulic pressure chamber and the retardation side hydraulic pressure chamber, wherein the seal member may be arranged so as to apply a hydraulic pressure from the retardation side hydraulic pressure chamber on the flange section of the lock member, and to apply a hydraulic pressure from the advance side hydraulic pressure chamber on the head section and the flange section of the lock member. In this way, even if an active release hydraulic pressure is reduced on selecting the OCV intermediate retained mode, it can apply the release hydraulic pressure on larger area of the lock member to ensure release of the lock member and to ensure stable operation of the device.

DESCRIPTION OF THE PREFERRED EMBODIMENT OF THE INVENTION

Hereafter, a first embodiment of the present invention will be explained.

Embodiment 1

Figure 1:
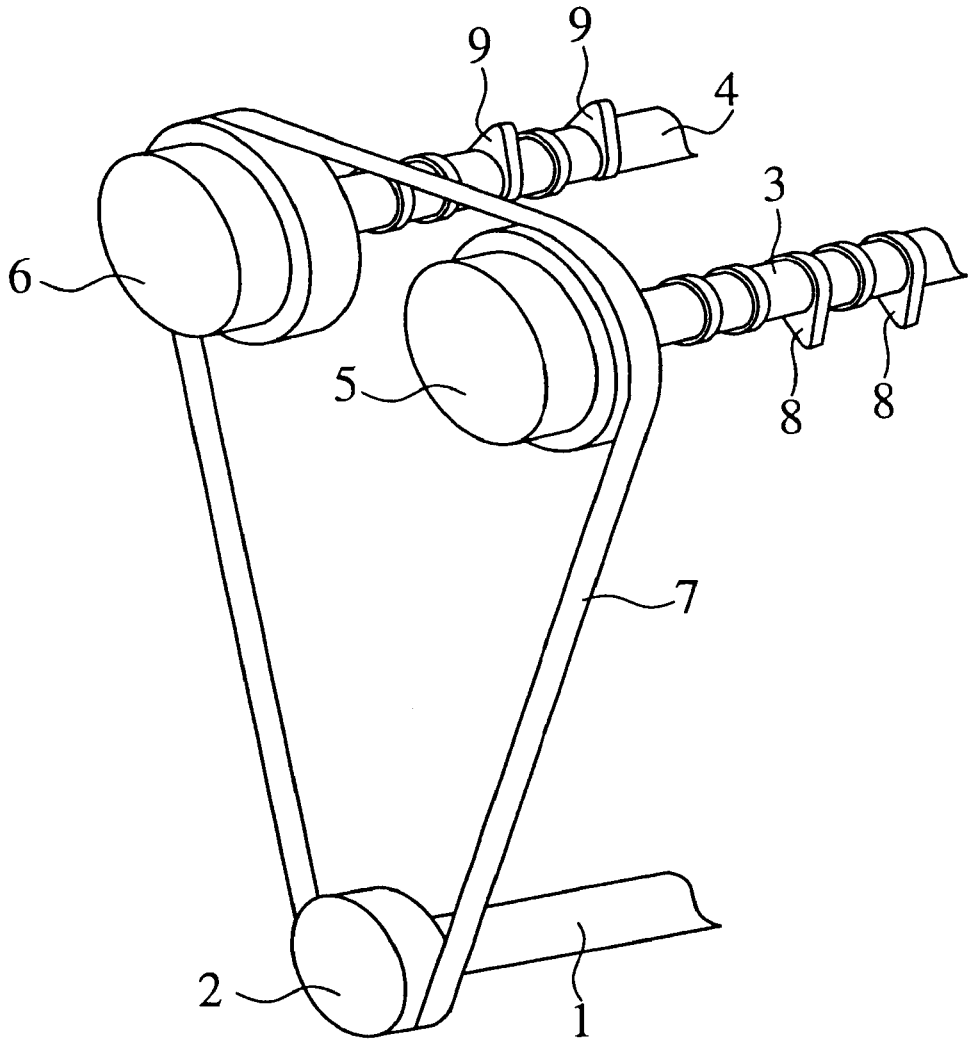
FIG. 1 is a perspective view of a valve system of the engine equipped with a valve timing control device according to the present invention.
Figure 2:
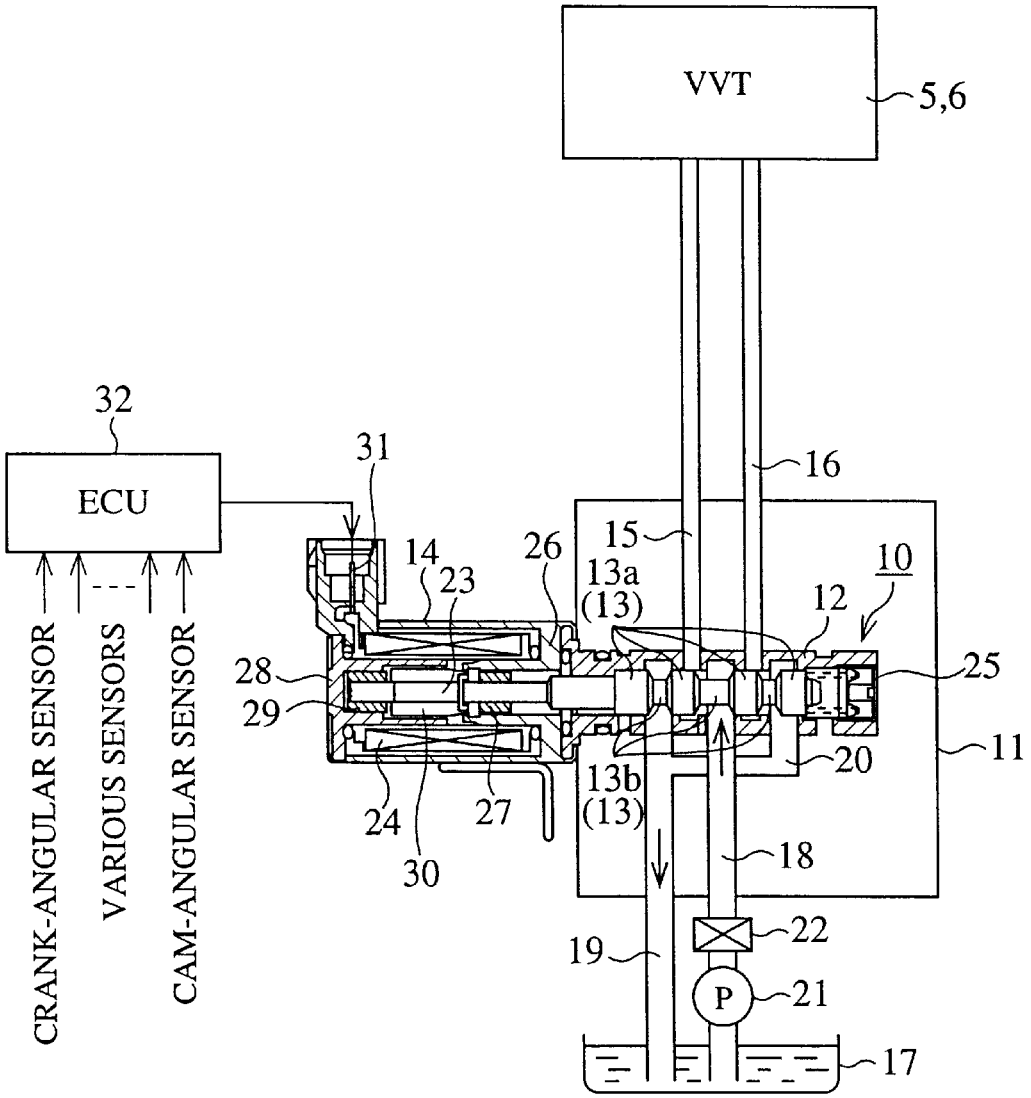
FIG. 2 is a partial cross sectional view of an internal construction of an oil control valve for supplying a hydraulic pressure to the valve timing control device shown in FIG. 1.
Figure 3:
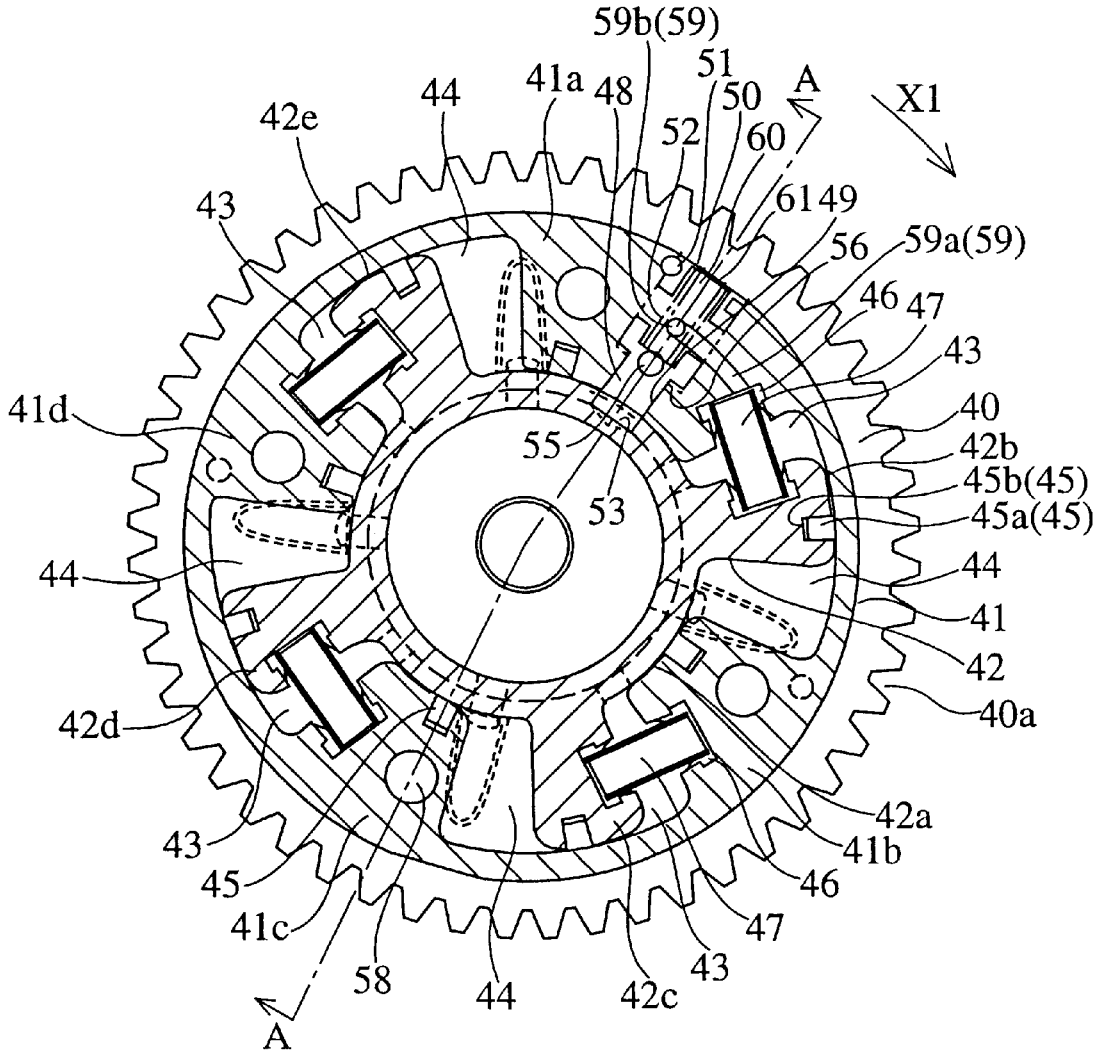
FIG. 3 is a lateral cross sectional view of an internal construction of a valve timing control device as embodiment 1 according to the present invention.
Figure 4:
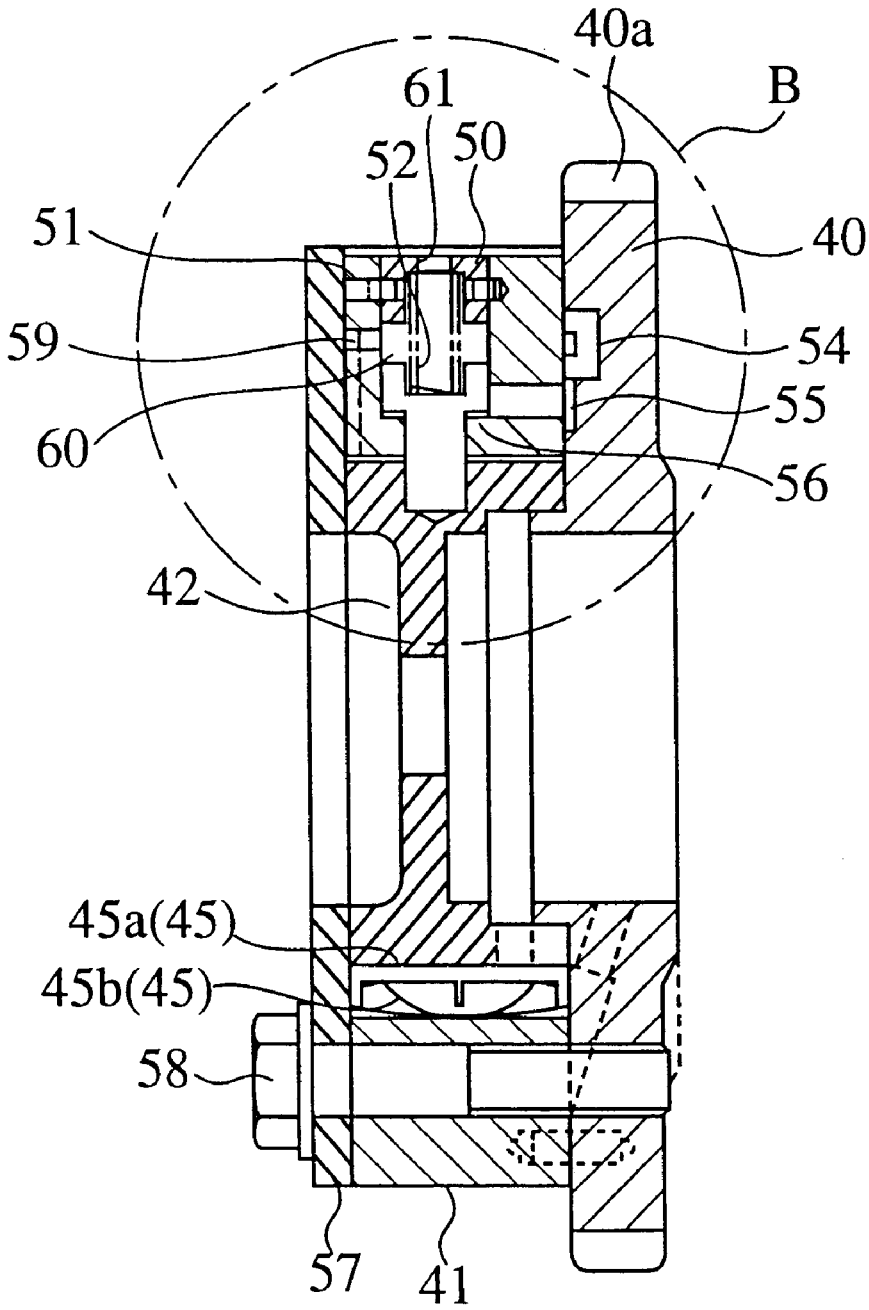
FIG. 4 is a cross sectional view taken along lines A—A of FIG.3.
Figure 5:
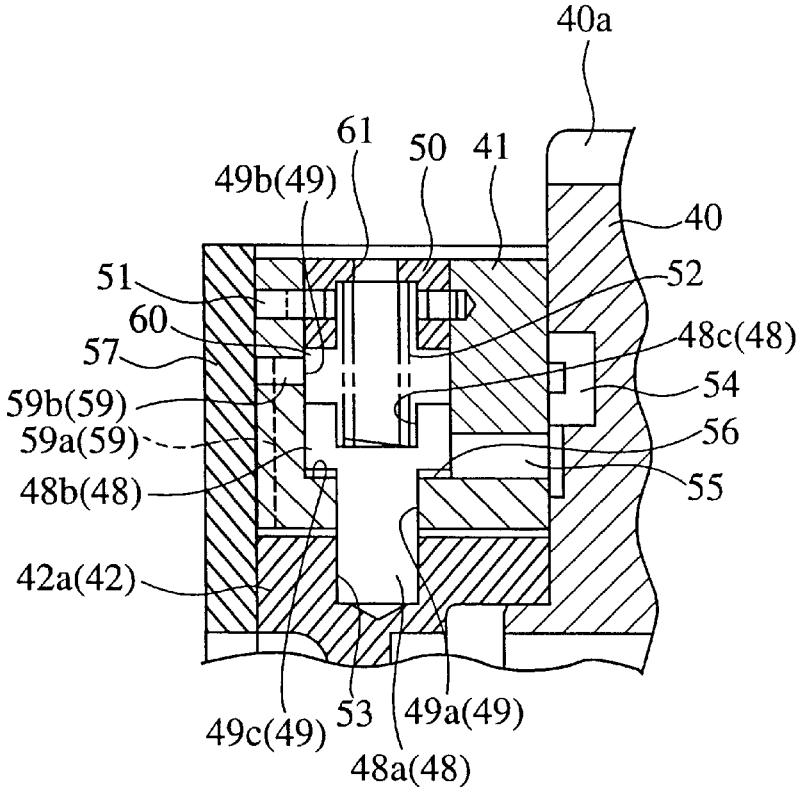
FIG. 5 is an enlarged cross sectional view of a main point B of FIG. 4.
Figure 6:
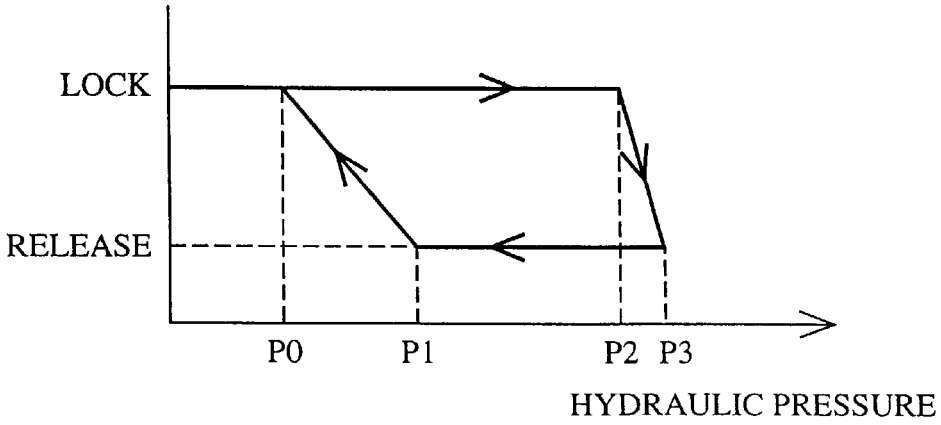
FIG. 6 is a graph showing a relation of a release hydraulic pressure and an operation of the lock member in the valve timing control device shown in FIG. 3, FIG. 4 and FIG. 5.

FIG. 1 is a perspective view of a valve system of the engine equipped with a valve timing control device according to the present invention. FIG. 2 is a partial cross sectional view of an internal construction of an oil control valve for supplying a hydraulic pressure to the valve timing control device shown in FIG. 1. FIG. 3 is a lateral cross sectional view of an internal construction of a valve timing control device as embodiment 1 according to the present invention. FIG. 4 is a cross sectional view taken along lines A—A of FIG.3. FIG. 5 is an enlarged cross sectional view of a main point B of FIG. 4. FIG. 6 is a graph showing a relation of a release hydraulic pressure and an operation of the lock member in the valve timing control device shown in FIG. 3, FIG. 4 and FIG. 5.

In FIG. 1, reference numeral 1 denotes a crankshaft of an engine (not shown) and numeral 2 denotes a chain sprocket fixed on an end of the crankshaft 1. Numeral 3 denotes an intake camshaft, and numeral 4 denotes an exhaust camshaft. Numeral 5 denotes a variable valve timing control device (hereafter, referred as an intake VVT) arranged at an end of the intake. camshaft 3. Numeral 6 denotes a variable valve timing control device (hereafter, referred as an exhaust VVT) arranged at an end of the exhaust camshaft 4. Numeral 7 denotes a timing chain (a driving force transmitting means) transmitting a rotational driving force from the crankshaft 1 to the intake camshaft 3 and the exhaust camshaft 4 via the chain sprocket 2, the intake VVT 5 and the exhaust VVT 6. A cam 8 has a cam face making contact with an intake valve (not shown) of the engine (not shown) and is integrally arranged on the intake camshaft 3. A cam 9 has a cam face making contact with an exhaust valve (not shown) and is integrally arranged on the exhaust camshaft 4.

A hydraulic pressure is provided to and discharged from the intake VVT 5 and the exhaust VVT 6 due to an OCV 10 as shown in FIG. 2, for example. The OCV 10 is arranged in an engine block 11. The OCV 10 includes a cylindrical-shaped valve housing 12; a spool 13 slidably arranged in the valve housing 12 in the axial direction of the valve housing 12; and a magnetic drive section 14 of slidably driving the spool 13 in the axial direction. A first pipe 15, a second pipe 16, a supply pipe 18, a first drain pipe 19 and a second pipe 20 are connected with the perimeter of the valve housing 12, respectively. The first pipe 15 applies a hydraulic pressure to and discharges it from an advance side hydraulic pressure chamber as described later, of the intake VVT 5 or the exhaust VVT 6. The second pipe 16 applies a hydraulic pressure to and discharges it from a retardation side hydraulic pressure chamber as described later, of the intake VVT 5 or the exhaust VVT 6. The supply pipe 18 provides oil accumulated in an oil pan 17 to the valve housing 12. The first and second drain pipes 19 and 20 return the oil in the valve housing 12 to the oil pan 17. An oil pump 21 pumping up the oil from the oil pan 17 and an oil-filter 22 removing foreign materials from the oil pumped up by the oil pump 21 are arranged at the supply pipe 18.

A plurality of projections 13a and grooves 13*b*, corresponding to the first and second pipes 15 and 16, the supply pipe 18, the first and second drain pipes 19 and 20 are formed at the perimeter of the spool 13. The sliding of the spool 13 in the axial direction of the valve housing 12 allows communications between a pipe and the corresponding pipes. One end of the spool 13, which is illustrated as a left end in FIG. 2, coaxially butts against one end, which is illustrated as a right end in FIG. 2, of a rod 23 arranged as a movable axial member in the magnetic drive section 14. A magnetic attracting force due to a linear-solenoid 24 of the magnetic drive section 14 allows the rod 23 to push the spool 13 toward the side of the valve housing 12 against a pushing force due to a spring 25 arranged in the valve housing 12. A cylindrical-shaped boss 26 is arranged at one end of the axial direction of the magnetic drive section 14. A first sleeve 27 is press-fitted and fixed in the boss 26 and functions as a sleeve bearing which can accommodate and support one end of the rod 23. A core 28 is opposed to the boss 26 in the axial direction and is arranged at the other end of the axial direction of the magnetic drive section 14 acting as a component of the magnetic drive section 14. A second sleeve 29 is press-fitted and fixed in the core 28 and functions as a sleeve bearing which can slide on and support the other end of the rod 23. A plunger 30 as a moving core is arranged between the first and second sleeves 27 and 29 and is fixed on the rod 23.

The linear-solenoid 24 is connected with an engine control unit (hereafter, referred as an ECU) 32 via a terminal 31.

The ECU 32 is connected with various sensors including a crank-angular sensor (not shown) acting as an angular sensor of the crankshaft 1, and a cam-angular sensor (not shown) acting as an angular sensor of the intake or exhaust cam 8 or 9, as shown in FIG. 1.

Next, an operation of the OCV 10 will be explained.

First, the ECU 32 drives the OCV 10 on the basis of signals from the cam-angular sensor (not shown), for example. In other words, signals from the ECU 32 bring the linear-solenoid 24 into generation of the magnetic attracting force moving the plunger 30 in the axial direction of the valve housing 12. The rod 23 fixed on the plunger 30 and the spool 13 butting the end of the rod 23 are slid against the pushing force of the spring 25 by a required stroke in synchronization with the movement of the plunger 30. According to the sliding stroke, the spool 13 links communications between the supply pipe 18 and the first pipe 15 or the second pipe 16, between the first drain pipe 19 or the second drain pipe 20 and the first pipe 15 or the second pipe 16. In this way, it is possible to provide the appropriate hydraulic pressure to and discharge the same from the advance side hydraulic pressure chamber and the retardation side hydraulic pressure chamber of the intake VVT 5 or the exhaust WT 6, if necessary.

Next, an internal construction of the intake VVT 5 or the exhaust VVT 6 will be explained.

In FIG. 3 to FIG. 5, reference numeral 40 denotes a housing integrated with a chain-sprocket section 40*a* receiving the rotational driving force from the crankshaft 1 via the timing chain 7 as shown in FIG. 1. Numeral 41 denotes a case positioned and fixed on the housing 40. The case 41 has a plurality of shoes 41*a*, 41*b* 41*c* and 41*d*, which are projected inwardly to form a plurality of hydraulic pressure chambers. Numeral 42 denotes a rotor having a boss section 42*a* and a plurality of vanes 42*b*, 42*c*, 42*d* and 42*e*. The boss section 42*a* is fixed on one end of the intake camshaft 3 or that of the exhaust camshaft 4 due to bolts (not shown). The vanes 42*b*, 42*c*, 42*d* and 42*e* divide the hydraulic pressure chambers into an advance side hydraulic pressure chambers 43 and a retardation side hydraulic pressure chambers 44. Seal members 45 are arranged at ends of the shoes 41*a*, 41*b* 41*c* and 41*d* of the case 41 and those of the vanes 42*b*, 42*c*, 42*d* and 42*e* of the rotor 42. Each seal member 45 prevents operating oils from flowing between the advance side hydraulic pressure chamber 43 and the retardation side hydraulic pressure chamber 44 to keep the hydraulic pressure in the each hydraulic pressure chamber. The seal member 45 includes a seal 45*a* made of flexible resins and a plate spring 45*b* pushing the seal 45*a* to a face as opposed to the seal 45*a*. The opposing face is defined as the perimeter of the rotor 42 when the seal member 45 is arranged at the case 41, and is defined as the inner radius of the case 41 when the seal member 45 is arranged at the rotor 42.

Assist springs 47 are arranged between the shoes 41*a*, 41*b* 41*c* and 41*d* of the case 41 and the vanes 42*b*, 42*c*, 42*d* and 42*e* of the rotor 42, respectively, in the advance side hydraulic pressure chambers 43. The respective assists prings 47 are held by holders 46 to push the rotor 42 with respect to the case in an advance direction (an X1 direction expressed by an arrow in FIG. 3).

In the drawings, numeral 48 denotes a lock-pin (lock member) restricting free rotation defined between the case 41 and the rotor 42 on starting the engine and allowing the free rotation on normal operation. The lock-pin 48 includes a cylindrical-shaped head section 48*a*, a flange section 48*b* having an outer diameter larger than that of the head section 48*a* and a recess section 48*c* formed at a central bottom of the flange section 48*b*. With the embodiment, the lock-pin 48 is arranged in an accommodation hole 49 formed at the front end of the shoe 41*a* of the case 41 in a radial direction of the device (hereafter, referred as a radial direction). The accommodation hole 49 includes a minor radius section 49*a* and a major radius section 49*b*. The minor radius section 49*a* has an inner diameter corresponding to the outer diameter of the head section 48*a* of the lock-pin 48 and opens toward the boss 42*a* of the rotor 42. The major radius section 49*b* has an inner diameter corresponding to the outer diameter of the flange section 48*b* of the lock-pin 48 and opens toward the outermost perimeter of the device. A stopper 50 is arranged in the major diameter section 49*b* of the accommodation hole 49. The stopper 50 retains a coil-spring as described later in the accommodation hole 49, and defines a moving range of the lock-pin 48. A pin 51 prevents the stopper 50 from coming out of the accommodation hole 49. A coil-spring 52 is arranged between the stopper 50 and the recess section 48*c* of the lock-pin 48 to push the lock-pin 48 toward the boss 42*a* of the rotor 42 at all times.

On the other hand, a fitting hole 53 is arranged at an intermediate position, which is opposed to the shoe 41*a* of the case 41, of the perimeter of the boss 42*a* of the rotor 42 the position being apart from both of the maximum advanced and retardation side positions. With the maximum advanced side position, the shoe 41*a* makes contact with the vane 42*e* of the rotor 42. With the maximum retarded side position, the shoe 41*a* makes contact with the vane 42*b*. The fitting hole 53 is formed in the radial direction in a manner similar to the accommodation hole 49 described above.

A hydraulic pressure switch valve 54 is arranged at the confluence of an oil passage (not shown) communicating to the advance side hydraulic pressure chamber 43 and an oil passage (not shown) communicating to the retardation side hydraulic pressure chamber 44. The confluence is formed on an end face of the housing 40 close to the case 41. The hydraulic pressure switch valve 54 selects and applies a higher hydraulic pressure from within the hydraulic pressures of the advance side hydraulic pressure chamber 43 and the retardation side hydraulic pressure chamber 44 to a release hydraulic pressure chamber 56 via a release hydraulic pressure supply passage 55. The release hydraulic pressure chamber 56 is formed between the flange section 48*b* of the lock-pin 48 and a tier section 49*c*, which is defined between the minor radius section 49*a* and the major radius section 49*b*, of the accommodation hole 49. When the release hydraulic pressure is provided to the release hydraulic pressure chamber, the lock-pin 48 moves backward against the pushing force of the coil-spring 52 and is released from the fitting hole 53.

A cover 57 is fixed on the end face of the case 41 in the axial direction due to a threaded member 58 such as bolts as shown in FIG. 4 and FIG. 5. A first communication passage 59 is arranged in the shoe 41*a* of the case 41. The first communication passage 59 includes a communication groove 59*a* formed at one end face of the shoe 41*a* in the axial direction to communicate with the advance side hydraulic pressure chamber 43; and a communication hole 59*b* communicating the communication groove 59*a* to a rear space (hereafter, referred as a backward pressure chamber) 60 of the lock-pin 48 in the major radius section 49*b* of the accommodation hole 49. A second communication passage 61 is arranged at a central portion of the stopper 50 to communicate the backward pressure chamber 60 to the outside of the device. The cross sectional area of the second communication passage 61 is set to be smaller than the minimum cross sectional area of the first communication passage 59, and is set to be larger than that the cross sectional area allowing discharge of foreign materials. In this way, it is possible to prevent instability of the release operation as a result of blocking the passages with the foreign materials and of increasing passage resistance in the passages. This also reduces the frequency of maintenance which allows reductions in costs.

Next, an operation of the intake VVT 5 or the exhaust VVT 6 will be explained.

First, when the crankshaft 1 is rotated on starting the engine, the rotational driving force is transmitted to the intake camshaft 3 and the exhaust camshaft 4 via the timing chain 7, the intake VVT 5 and the exhaust VVT 6. Here, on starting the engine, the number of revolutions is naturally low and the oil pump is not activated sufficiently. A hydraulic pressure is not provided for keeping the VVT. However, even if the lock-pin 48 is not fit in the fitting hole 53 on stopping the engine and the hydraulic pressure is not provided sufficiently on starting the engine, flutters of the rotor 42 do not cause abnormal noises due to the following reasons. In other words, during cranking on starting the engine, the rotor 42 rotates in the advance direction shown by the arrow X1 of FIG. 3 due to cam loads and the assist spring 47 as the camshaft rotates. In this way, the rotor 42 rotationally moves to a lock position and the head section 48*a* of the lock-pin 48 is fit in the fitting hole 53 formed in the boss 42*a* of the rotor 42 due to the pushing force of the coil-spring 52. The rotor 42 changes from the release-state to the lock-state that the free rotation between the rotor 42 and the case 41 is restricted. Since the rotor 42 is thus locked at the reference position during the cranking on starting the engine, abnormal noises caused by the flutters of the rotor 42 and engine knocking do not arise. The engine can be therefore started with stability.

Moreover, in order to improve fitting of the lock-pin 48, the oil passages are controlled so as to communicate with the advance side hydraulic pressure chambers in both of the intake VVT 5 and the exhaust VVT 6 on starting the engine. In other words, in the embodiment 1, a VVT fail-safe position of the intake VVT 5 is set to the maximum retarded_side position and that of the exhaust VVT 6 is set to the maximum advanced side position, for example. In the intake VVT 5, the plunger 30 is slid in the axial direction of the valve housing 12 due to the magnetic attracting force generated by the linear-solenoid 24 on the basis of the control signal from the ECU 32. The rod 23 fixed on the plunger 30 causes the spool 13 to slide in the valve housing 12 by a required stroke. In this way, in the intake VVT 5, the oil passages can be communicated to the advance side. On the other hand, in the exhaust VVT 6, the control signal from the ECU 32 is set to 100 mA. The spool 13 is held at a zero-moving position due to the pushing force of the spring 25. In the exhaust VVT 6 in a manner similar to the intake VVT 5, the oil passages can be communicated with the advance side.

Next, after the engine undergoes complete combustion and a certain hydraulic pressure is provided to the intake VVT 5 or the exhaust VVT 6, the hydraulic pressure is provided to first the advance side hydraulic pressure chamber 43 in any of the cases. The pressure in the chamber 43 is further provided to the hydraulic pressure switch valve 54, the release hydraulic pressure supply passage 55 and the release hydraulic pressure chamber 56. Since the flange section 48*b* of the lock-pin 48 is subjected to the hydraulic pressure provided to the release hydraulic pressure chamber 56, the lock-pin 48 moves backward when the hydraulic pressure overcomes the pushing force of the coil-spring 52. Simultaneously, the hydraulic pressure provided to the advance side hydraulic pressure chamber 43 is discharged to the outside via the first and second communication passages 59 and 61 until the time when the lock-pin 48 is entirely released and the flange section 48*b* closes the first communication passage 59.

Here, when oil remains in the oil passages of the intake VVT 5 or the exhaust VVT 6 and in the hydraulic pressure chambers and the engine is restarted for example soon after stopping the engine, the oil pump activates after starting the engine to provide oil pressure. Due to adequate hydraulic pressure, the lock-pin 48 can be smoothly released and at the same time the rotor 42 can be held against the cam loads. In this way, it can prevent the occurrence of the abnormal noises due to the flutters of the rotor 42. However, for example, when the engine is restarted after while stopping the engine, oil is discharged from the oil passages of the intake VVT 5 or the exhaust VVT 6 and the respective hydraulic pressure chambers and air enters the above components. Here, air in the oil passages is compressed as the oil is filled with starting the engine to generate slightly pressure in the release hydraulic pressure chamber 56 depending on the air pressure. As the lock-pin 48 is released under the air pressure, it is impossible to hold the rotor 42 under an unstable hydraulic pressure resulting from air filling the oil passages with a small quantity of oil and thus causing abnormal noises by the flutters of the rotor 42. In order to resolve this problem, it is assumed that a load of the coil-spring 52 is set to a large amount. As the load of the coil-spring 52 is however set to the large amount, the minimum level of the hydraulic pressure allowing control of the intake VVT 5 or the exhaust VVT 6 increases and narrows a controllable hydraulic pressure area.

With the embodiment 1, discharge of air in the intake VVT 5 or the exhaust VVT 6 at a required period after starting the engine can be ensured due to the first and second communication passages 59 and 61 as described above. It can prevent the accidental release of the lock-pin 48 due to the air pressure. The cross sectional area of the second communication passage 61 is set to be smaller than the minimum cross sectional area of the first communication passage 59. The hydraulic pressure in the advance side hydraulic pressure chamber 43 which acts as a backward pressure of the lock-pin 48 is purged to the backward pressure chamber 60 via the first communication passage 59. It is therefore possible to delay the release operation on application of the hydraulic pressure to the advance side hydraulic pressure chamber. In this case, the lock-pin 48 is released under a condition that the hydraulic pressure provided to the release hydraulic pressure chamber 56 is larger than the sum of the load of the coil-spring 52 and the backward pressure of the backward pressure chamber 60. In other words, the hydraulic pressure keeps rising after starting the engine and reaches a high hydraulic pressure (release-starting hydraulic pressure) P2 as shown in FIG. 6. Here, the release hydraulic pressure (hydraulic pressure in the release hydraulic pressure chamber 56) is larger than the sum of the load of the coil-spring 52 and the backward pressure of the backward pressure chamber 60, the lock-pin 48 starts moving backward. Subsequently, under a hydraulic pressure P3 being higher than the hydraulic pressure P2, the head section 48*a* of the lock-pin 48 is completely released out of the fitting hole 53 to finish the release operation. If the first communication passage 59 is not disposed, there is no difference between the release-starting hydraulic pressure P2 and a hydraulic pressure P0 shown in FIG. 6, and there is no difference between the hydraulic pressure (release-finishing hydraulic pressure) P3 and a hydraulic pressure P1 shown in FIG. 6. According to the embodiment 1, the first communication passage 59 is disposed, and the cross-sectional area of the passage 59 is larger than that of the second communication passage 61 acting as a drain passage for the hydraulic pressure and air pressure. It is therefore possible to set a difference between the release-starting hydraulic pressure P2 and the release-finishing hydraulic pressure P3 as follows. In other words, the hydraulic pressure of the advance side hydraulic pressure chamber 43 is provided to the release hydraulic pressure chamber 56 via the hydraulic switch valve 54 and the release hydraulic pressure supply passage 55, and to the backward pressure chamber 60 via the first communication passage 59. The release hydraulic pressure chamber 56 is sealed due to a clearance defined between the minor or major radius sections 49*a* or 49*b* of the accommodation hole 49 formed in the shoe 41*a* of the case 41 and the head or flange sections 48*a* or 48*b* of the lock-pin 48. In this way, the hydraulic pressure in the release hydraulic pressure chamber 56 can be kept. On the other hand, the hydraulic pressure provided to the backward pressure chamber 60 is discharged to the outside via the second communication passage 61 at the constant quantity of flow, and does not rise to a pressure higher than a certain hydraulic pressure. Because of the difference between the hydraulic pressures in the chambers, the release hydraulic pressure 56 reaches the hydraulic pressure P2 which is larger than the sum of the load of the coil-spring 52 and the backward pressure of the backward pressure chamber 60 and starts the release operation. As the release operation is started, the pushing force of the coil-spring 52 is increased by compressing the coil-spring 52, and reaches the hydraulic pressure P3 on finishing the release operation.

Moreover, as the lock-pin 48 moves backward to release the lock-pin 48, the first communication passage 59 is closed with the flange section 48*b* of the lock-pin 48. Thus, since the hydraulic pressure is not discharged to the outside via the first and second communication passages 59 and 61, a state of readiness is maintained in order to perform normal operation later.

Inversely, on locking, the lock-pin 48 starts fitting in the fitting hole 53 under a lower hydraulic pressure (lock-starting hydraulic pressure) P1, and completely fits in the fitting hole 53 under the hydraulic pressure P0 to change to the lock-state. Here, the value of the hydraulic pressures P1 and P0 change in response to the set load of the coil-spring 52, respectively. The lock-starting hydraulic pressure P1 is set to be nearly equal to or lower than a hydraulic pressure of generating a torque generated in the device, the torque being equal to a cam-torque of the engine. In this way, even under the minimum hydraulic pressure condition such as high temperature oil or idle rotation for example, it can obviate the inconvenience of fitting the lock-pin 48 in the fitting hole 53 or getting trapped therein. As a result, the device can reliably control the operation of the lock-pin 48 and the VVT.

Next, when idling after the engine undergoes complete combustion, the OCV 10 is set to a intermediate retained mode to hold the rotor 42 at an approximately intermediate position (lock position) as the reference position on starting, outside controlling the intake VVT 5 or the exhaust VVT 6. In the intermediate retained mode of the OCV 10, the first pipe 15 acting as the advance side port is slightly opened, and the second pipe 16 acting as the retardation side port is opened as a drain. In this way, the hydraulic pressure corresponding to the cam load can be applied to the advance side hydraulic pressure chamber 43.

With the general intermediate retained mode of the OCV 10, the first pipe 15 is small in cross-section opening area, and acts as a throttle. The hydraulic pressure allowing application to the advance side hydraulic pressure chamber 43 and the release hydraulic pressure 56 is nearly equal to one-half of the minimum hydraulic pressure of upstream the OCV 10. Thus, the lock-pin 48 is not completely released. On keeping the intermediate position of the rotor 42, as a lower hydraulic pressure provided from the oil pump, there is a possibility that the lock-pin 48 fits in the fitting hole 53 or getting trapped therein. Therefore, it is impossible to operate the lock-pin 48 from the intermediate retained position to the advance or retardation side. Since the lock-pin 48 makes contact with the fitting hole 53 at all times, both components undergo wear which decreases durability.

On the other hand, with the embodiment 1, since the occurrence of abnormal noises due to the flutters of the rotor 42 can be prevented on starting the engine, the load of the coil-spring 52 can be set to be small. Concretely, when the rotor 42 is kept at the intermediate position, an active hydraulic pressure of the advance side hydraulic pressure chamber 43 is reduced by half . In this case, the load of the coil-spring 52 can be determined so as to surely release the lock-pin 48 under a hydraulic pressure smaller than or equal to the hydraulic pressure (one half of the minimum hydraulic pressure of upstream the OCV 10). Shortly, the load of the coil-spring 52 can be set to a level smaller than the active release hydraulic pressure on keeping the rotor 42 at the intermediate position. As seen from FIG. 6, the lock-starting hydraulic pressure P1 corresponding to the load of the coil-spring 52 can be set to be lower than the hydraulic pressure of the release hydraulic pressure chamber 56 on the OCV intermediate retained mode. Further, the release-starting hydraulic pressure P2 can be set to be higher than an unstable hydraulic pressure of mixing air on starting the engine. Thus, the device can effectively change the release hydraulic pressure and the lock hydraulic pressure of the lock-pin 48 in some cases.

As described above, with the embodiment 1, the release hydraulic pressure P2 is set to be higher than the lock hydraulic pressure P1. In this way, since the load of the coil-spring 52 corresponding to the lock hydraulic pressure P1 is set to a low level. It can therefore reliably prevent an operational failure of the device even if a hydraulic pressure in the device is reduced by the OCV intermediate retained mode or even if the operation oil is consumed by operation of the device. The operational failure of the device is prevented, which generates when the lock-pin 48 pops up due to the pushing force of the coil-spring 52 to catch on or engage in the fitting hole 53.

With the embodiment 1, the lock hydraulic pressure P1 may be set to be nearly equal to or lower than a hydraulic pressure of generating a torque generated in the device, the torque being equal to a cam-torque of the internal-combustion. In this way, even under the minimum hydraulic pressure condition such as high temperature oil or idle rotation for example, it can obviate the inconvenience of fitting the lock-pin 48 in the fitting hole 53 or getting trapped therein. As a result, the operation of the lock-pin 48 can be reliably controlled.

With the embodiment 1, the first and second communication passages 59 and 61 are disposed in the VVT. In this way, since the backward pressure can be applied to the lock-pin 48 on releasing operation, the release hydraulic pressure P2 can be set to be higher than the lock hydraulic pressure P1. Since the release operation can be also delayed, air remaining in each passage and each chamber in the VVT can be rapidly and surely discharged through the first and second communication passages 59 and 61 to the outside on starting the engine. As a result, release operations, which are not predetermined and result from residual air, can be prevented.

With the embodiment 1, the first communication passage 59 is formed at the end of the case in the axial direction of the case 41. In this way, it is possible to easily process the first communication passage 59. It is also possible to shorten the length in the minimum cross sectional area of the first communication passage 59 to reduce passage resistance in the first communication passage 59. It is further possible to perform the release operation of the lock-pin 48 with stability. Moreover, with the embodiment 1, the communication groove 59*a* of the first communication passage 59 is formed at one end face of the shoe 41*a* in the axial direction of the case 41. Alternatively, the communication groove 59*a* may be formed at one end face of the cover 57 which makes contact with the one end face of the shoe 41*a*. In this case, it is also possible to easily process the communication passage and to reduce the passage resistance in the communication passage.

With the embodiment 1, the cross sectional area of the first communication passage 59 is set to be larger than that of the second communication passage 61. In this way, since the backward pressure can be surely applied to the backward pressure chamber 60, the release hydraulic pressure can be set to be higher than the lock hydraulic pressure.

With the embodiment 1, the cross sectional area of the second communication passage 61 is set to be larger than that the cross sectional area of allowing discharge of foreign materials. In this way, since the foreign materials in drain oil can be surely discharged from the backward pressure chamber 60 to the outside, it can prevent the second communication passage 61 from being blocked with the foreign materials and can reliably operate the lock-pin 48.

Moreover, with the embodiment 1, the stopper 50 is disposed at the outermost of the device, length of the second communication passage 61 formed at the center of the stopper 50 is made short to shorten a distance between the backward pressure chamber 60 and the outside. In other words, it is designed to leak oil for the release hydraulic pressure to the outside via the second communication passage 61. In this way, the backward pressure in the backward pressure chamber 60 can be drained to the outside without passage resistance resulting from the passage length or diameter. Even if the air is mixed in the oil in the hydraulic pressure chamber such as the advance side hydraulic pressure chamber 43 and so on, it is possible to set a stable difference between the release hydraulic pressure and the lock hydraulic pressure. This construction can be applicable to a case of using the timing chain 7 as the driving force transmitting means because the timing chain 7 has a driving force transmitting function that there is no harm in making contact with oil. If a timing belt is used as the driving force transmitting means, there is a possibility that the timing belt is cut due to making contact with the oil. It is therefore preferable that the second communication pas sage 61 communicates with the oil pan 17 of the device within the intake camshaft 3 or the exhaust camshaft 4.

Embodiment 2

Figure 7:
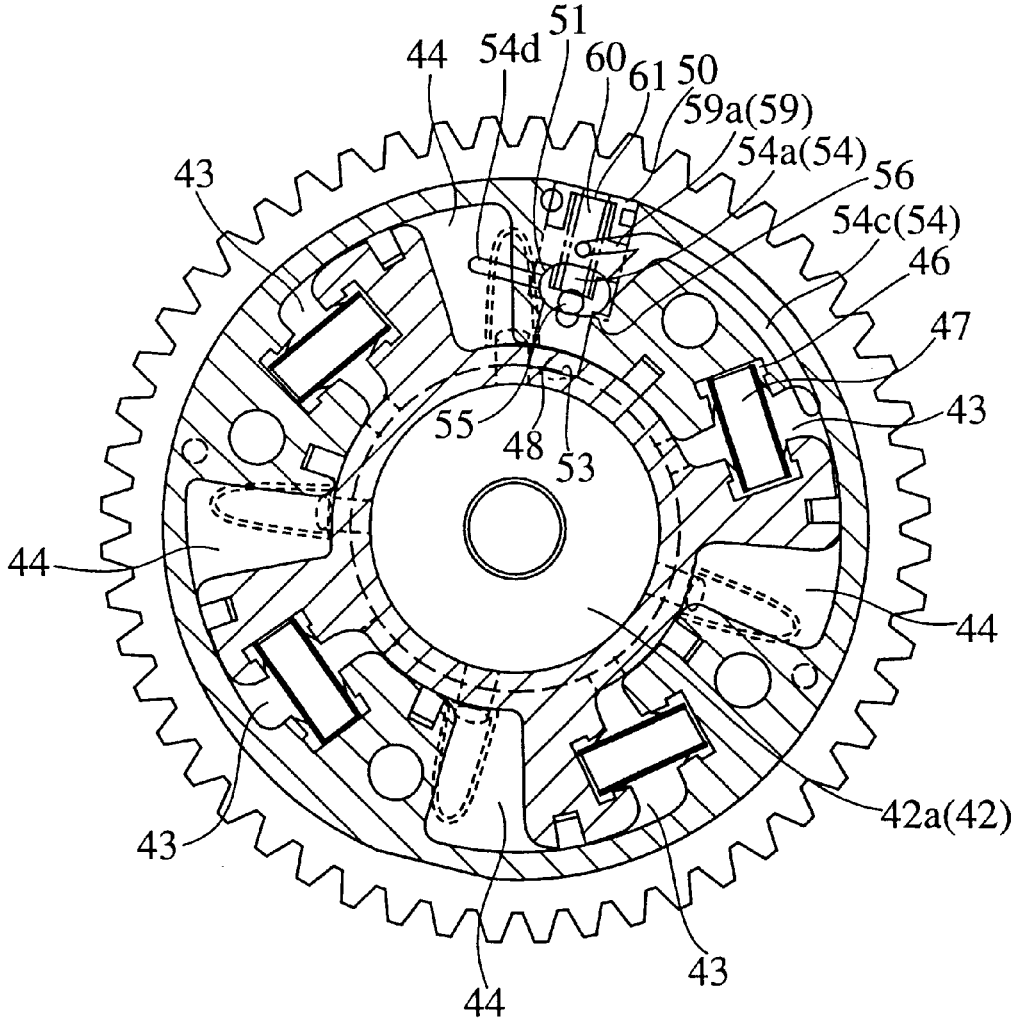
FIG. 7 is a lateral cross sectional view of an internal construction of a valve timing control device as embodiment 2 according to the present invention.

FIG. 7 is a lateral cross sectional view of an internal construction of a valve timing control device as embodiment 2 according to the present invention. Components of the embodiment 2 of the present invention which are the same as those of the embodiment 1 are denoted by the same reference numerals and further description will be omitted.

In FIG. 7, a hydraulic pressure switch valve 54 includes a valve groove 54*a*, an approximately cylindrical-shaped valve body 54*b*, an advance side communication groove 54*c* and a iretardation side communication groove 54*d*. The valve groove 54*a* is formed at an end face of the housing 40 close to the case 41 and has an about ellipse-shaped inner space. The valve body 54*b* is accommodated in the valve groove 54*a*. The advance side communication groove 54*c* is formed at the end face of the housing 40 close to the case 41 to communicate between the valve groove 54*a* and the advance side hydraulic pressure chamber 43. The retardation side communication groove 54*d* is formed at the end face of the housing 40 close to the case 41 to communicate between the valve groove 54*a* and the retardation side communication groove 54*d*. The embodiment 2 is characterized in that the communication groove 59*a* of the first communication passage 59 formed as a branch from the advance side communication groove 54*c* to communicate to the backward pressure chamber 60 via the communication hole 59*b*.

Although the first communication passage 59 of the embodiment 1 directly communicates the advance side hydraulic pressure chamber 43 to the backward pressure chamber 60, the first communication passage 59 of the embodiment 2 is formed as an additional passage branched from the already-existing communication groove. In this way, with embodiment 2, it is possible to easily process the first communication passage and to prevent passage resistance and to reduce manufacturing costs.

Moreover, with the embodiment 2, although the communication groove 59*a* of the first communication passage 59 is disposed as a branch from the advance side communication groove 54*c* , the communication groove 54*a* may be branched from the retardation side communication groove 54*d*, as required.

Embodiment 3

Figure 8:
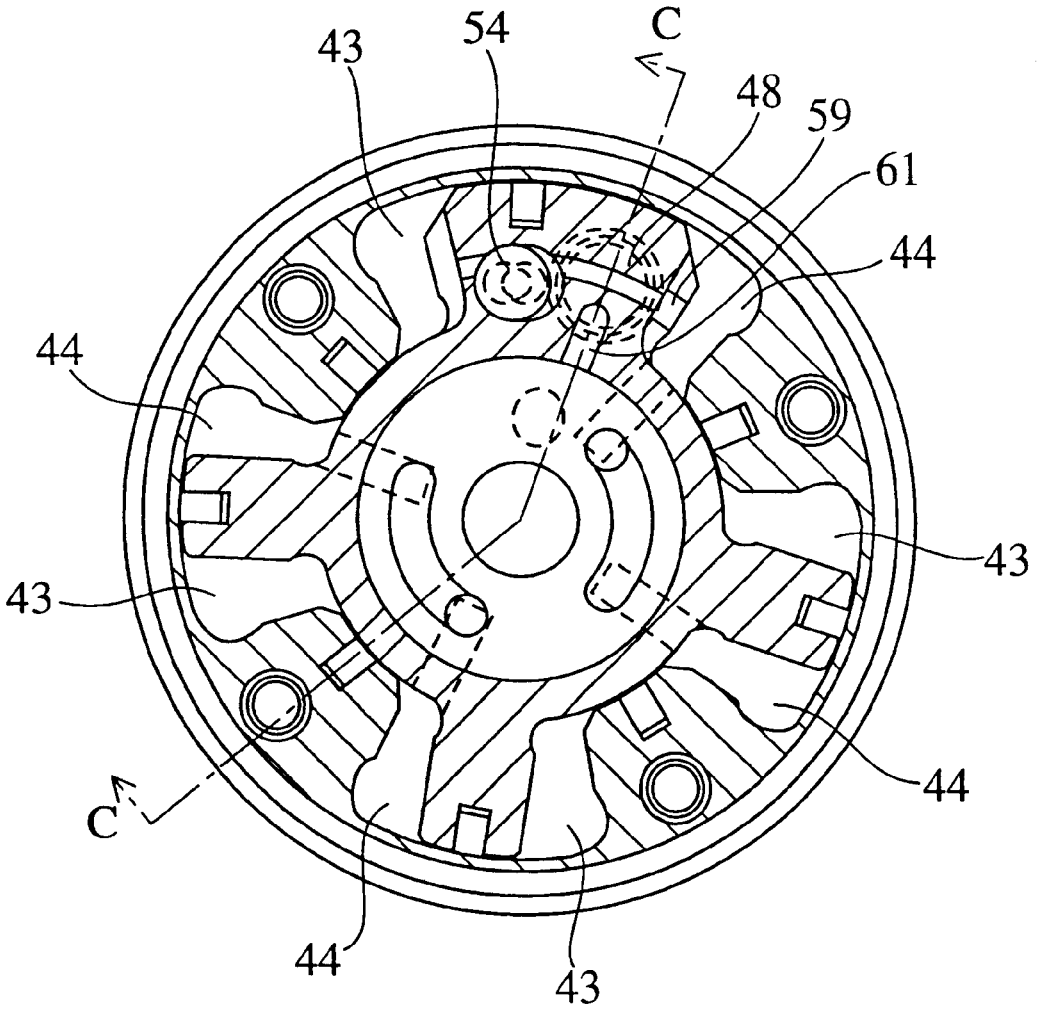
FIG. 8 is a lateral cross sectional view of an internal construction of a valve timing control device as embodiment 3 according to the present invention.
Figure 9:
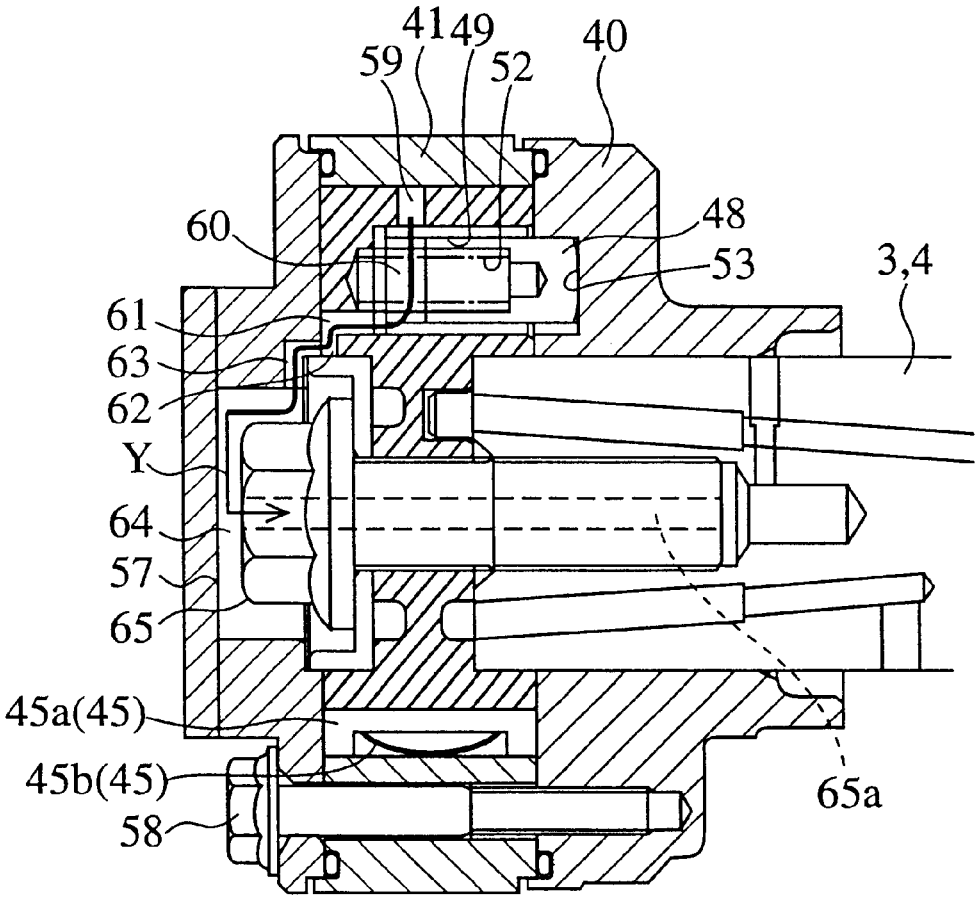
FIG. 9 is a cross sectional view taken along lines C—C of FIG.8.
Figure 10A:
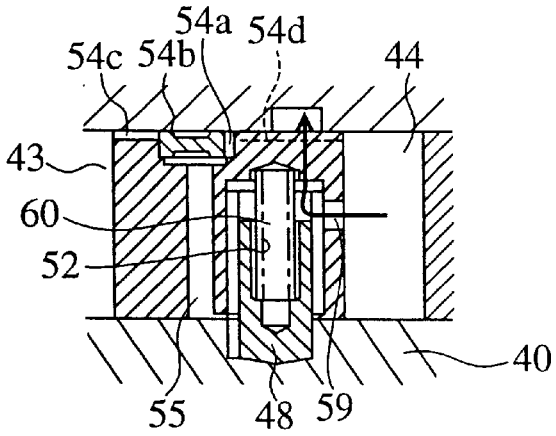
FIG. 10A is a cross sectional view of a locked state in the valve timing control device shown in FIG. 8 and FIG. 9.
Figure 10B:
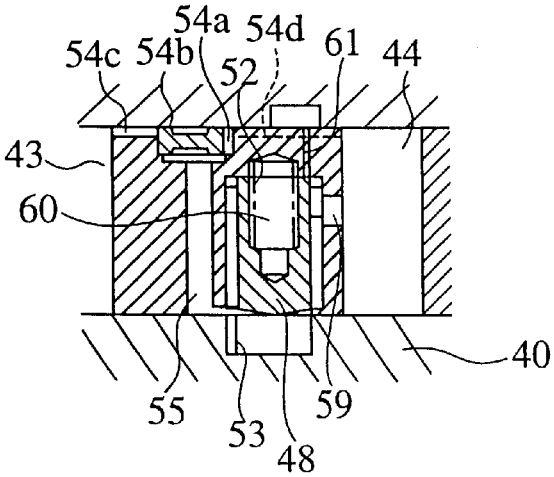
FIG. 10B is a cross sectional view of a released state in the valve timing control device shown in FIG. 8 and FIG. 9.

FIG. 8 is a lateral cross sectional view of an internal construction of a valve timing control device as embodiment 3 according to the present invention. FIG. 9 is a cross sectional view taken along lines C—C of FIG. 8. FIG. 10A is a cross sectional view of a locked state in the valve timing control device shown in FIG. 8 and FIG. 9. FIG. 10B is across sectional view of a released state in the valve timing control device shown in FIG. 8 and FIG. 9. Components of the embodiment 3 of the present invention which are the same as those of the embodiment 1 are denoted by the same reference numerals and further description will be omitted.

With the embodiment 3, the lock-pin 48 is slid in an axial direction of the device. This point is different from the embodiments 1 and 2 whose lock-pin 48 is slid in the radial direction of the device. A belt type is used as the driving force transmitting means in the embodiment 3. This point is different from the embodiments 1 and 2 using the chain type as the driving force transmitting means. Hereafter, the characterized construction will be explained. The lock-pin 48 does not have the head section 48*a* having a minor diameter, and includes the flange section 48*b* and the recess section 48*c*. The accommodation hole 49 is formed in the vane 42*b* of the rotor 42 close to the housing 40 in the axial direction. The fitting hole 53 is formed at a position of the housing 40 facing the accommodation hole 49. The first communication passage 59 communicating with the retardation side hydraulic pressure chamber 44 is arranged in the backward pressure chamber 60 acting as a backward section of the lock-pin 48 within the accommodation hole 49. The second communication passage 61 communicating with the outside is arranged in the backward pressure chamber 60. The second communication passage 61 is a path shown by arrow Y of FIG. 9. The passage 61 includes communication grooves 62 and 63, an oil space 64 and a communication hole 65*a*. The groove 62 is formed at the boss 42*a* of the rotor 42, and the groove 63 is formed at the inner radius of the cover 57. The oil space 64 is defined between the cover 57 and the rotor 42, and the communication hole 65*a* is formed in a center bolt 65 for fixing the VVT device on the camshaft. The oil passed through the passage 61 is passed though oil passages within the intake camshaft 3 or the exhaust camshaft 4, and is returned to the oil pan 17. In this way, it can prevent the oil from discharging to the outside of the device, and can also avoid the inconvenience due to the adhesion of oil to the belt as the driving force transmitting means.

Next, an operation of the lock-pin 48 will be explained.

First, on releasing the lock-state, the hydraulic pressure switch valve 54 is switched due to the hydraulic pressure of the retardation side hydraulic pressure chamber 44. The release hydraulic pressure is then provided to the fitting hole 53 via the release hydraulic supply passage 55 and the release hydraulic pressure chamber 56, and acts on the front end of the lock-pin 48. The hydraulic pressure of the retardation side hydraulic pressure chamber 44 is also provided to the backward pressure chamber 60 via the first communication passage 59 as shown in FIG. 10A, and is discharged via the second communication passage 61 to outside the device. The hydraulic pressure is constantly applied to the backward pressure chamber 60 until the time when the lock-pin 48 moves backward to close the first communication passage 59. The supply of the hydraulic pressure to the backward pressure chamber 60 is stopped at the same time when the first communication passage 59 is closed as shown in FIG. 10B. In this way, the hydraulic pressure supplied to the backward pressure chamber 60 acts as the backward pressure of the lock-pin 48, and acts against the release hydraulic pressure, in cooperation with the pushing force of the coil-spring 52. It is therefore possible to delay the release operation of releasing the lock-pin 48, and eventually enhance the release hydraulic pressure.

As described above, with a type of sliding the lock-pin 48 in the axial direction of the embodiment 3, the release hydraulic pressure can be set to be higher than the lock hydraulic pressure corresponding to the load of the coil-spring 52. It is possible to set the load of the coil-spring 52 to a low level. It can therefore reliably prevent an operational failure of the device even if a hydraulic pressure in the device is reduced by the OCV intermediate retained mode or even if the operation oil is consumed by operation of the device. The operational failure of the device is prevented, which generates when the lock-pin 48 pops up due to the pushing force of the coil-spring 52 to catch on or engage in the fitting hole 53.

With the embodiment 3, the first and second communication passages 59 and 61 are disposed to delay the release operation. Air remaining in each passage and each chamber in the VVT can be rapidly and surely discharged through the first and second communication passages 59 and 61 to the outside on starting the engine. As a result, release operations, which are not predetermined and result from residual air, can be prevented.

Embodiment 4

Figure 11:
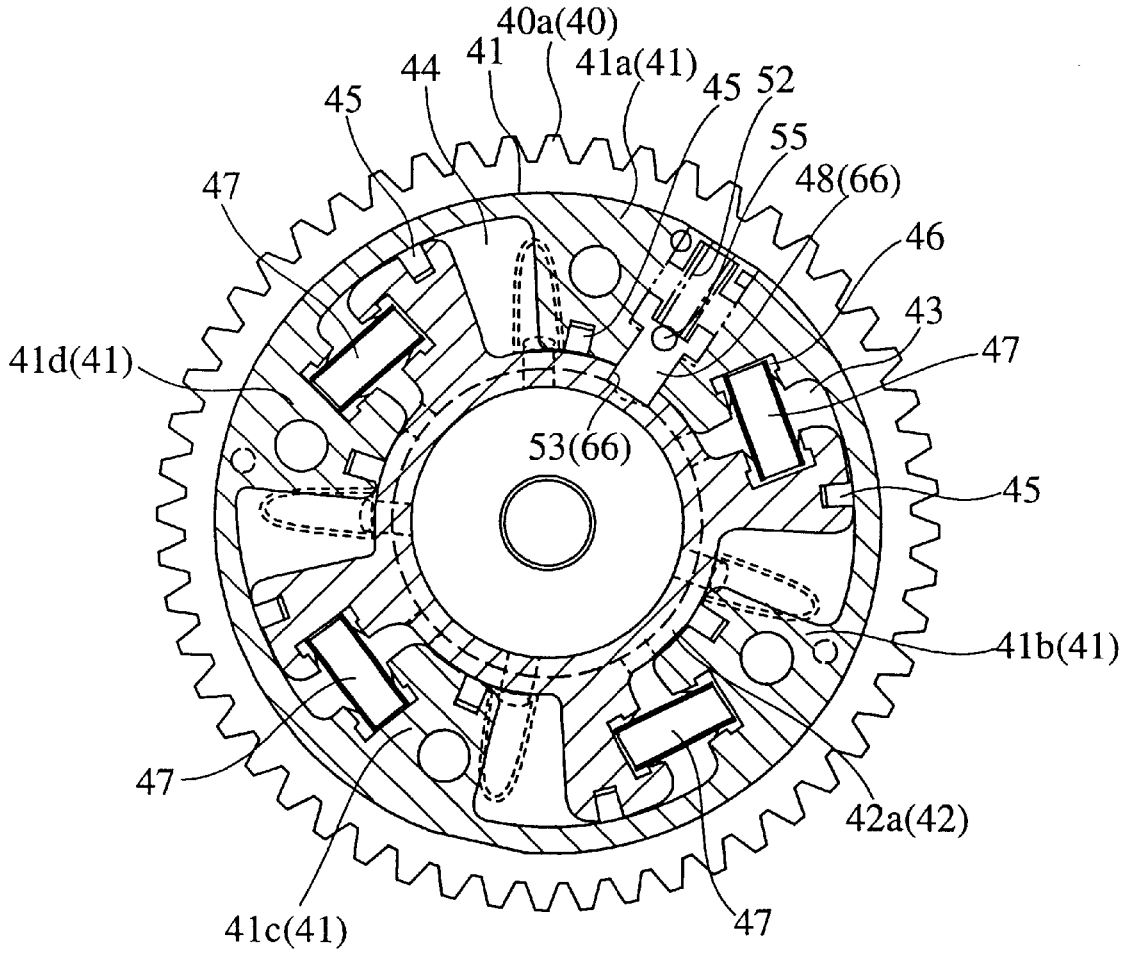
FIG. 11 is a lateral cross sectional view of an internal construction of a valve timing control device as embodiment 4 according to the present invention.

FIG. 11 is a lateral cross sectional view of an internal construction of a valve timing control device as embodiment 4 according to the present invention. Components of the embodiment 4 of the present invention which are the same as those of the embodiment 1 are denoted by the same reference numerals and further description will be omitted.

The embodiment 4 is characterized in that the seal member 45 is disposed at a position close to the retardation side hydraulic pressure chamber 44 in comparison with a lock mechanism 66 including the lock-pin 48 and the fitting hole 53. In other words, the hydraulic pressure of the advance side hydraulic pressure chamber 43 is used as the release hydraulic pressure. In this case, the advance side hydraulic pressure is applied to the flange section 48*b* of the lock-pin 48 via the hydraulic pressure switch valve 54, the release hydraulic pressure supply passage 55 and the release hydraulic pressure chamber 56. Simultaneously, the pressure is applied to the head section 48*a* of the lock-pin 48 fitted in the fitting hole 53 via a slight gap defined between a front end of the shoe 41*a* of the case 41 and the perimeter of the boss 42*a* of the rotor 42. The hydraulic pressure of the retardation side hydraulic pressure 44 is used as the release hydraulic pressure. In this case, the pressure is applied to only the flange section 48*b* of the lock-pin 48 via the hydraulic pressure switch valve 54, the release hydraulic pressure supply passage 55 and the release hydraulic pressure chamber 56.

As described above, with the embodiment 4, the seal member 45 is disposed in order that the release hydraulic pressure derived from the retardation side hydraulic pressure chamber 44 acts on the flange section 48*b* of the lock-pin 48, and that the release hydraulic pressure derived from the advance side hydraulic pressure chamber 43 acts on the head section 48*a* and the flange section 48*b* of the lock-pin 48. In this way, even if an active release hydraulic pressure is reduced on selecting the OCV intermediate retained mode, it can apply the release hydraulic pressure on larger area of the lock member to surely release the lock member and to operate the device with stability.

The present invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A valve timing control device for modifying an opening and closing timing of an intake valve or an exhaust valve making contact with cams fixed on an intake camshaft or an exhaust camshaft of an internal-combustion engine, comprising:

a housing rotating in synchronization with a driving force transmitting means transmitting a driving force from a crankshaft of the internal-combustion engine to an intake camshaft and an exhaust camshaft;

a case fixed on the housing and having a plurality of shoes which are projected inwardly to form a plurality of hydraulic pressure chambers;

a rotor fixed on an end of the intake camshaft or the exhaust camshaft and having a plurality of vanes to divide the hydraulic pressure chambers into advance side hydraulic pressure chambers and retardation side hydraulic pressure chambers;

a fitting hole arranged on one of the rotor or the case;

a lock member arranged on the other of the rotor or the case and fit in the fitting hole to lock the rotor in relation to the case at an approximately intermediate position apart from both of the maximum advanced side position and the maximum retarded side position;

a push member normally biasing the lock member in a direction fitting the lock member in the fitting hole, wherein a release hydraulic pressure for releasing the fitting state of the lock member in the fitting hole against the push force of the push member is set to be higher than a lock hydraulic pressure for allowing the fitting state of the lock member in the fitting hole; and first and second communication passages, wherein the first communication passage communicates a backward pressure chamber, in which the push member is arranged, to the advance side hydraulic pressure chamber or the retardation side hydraulic pressure chamber as an operational hydraulic pressure chamber of operating the device, and wherein the second communication passage communicates the backward pressure chamber to outside the device.

2. A valve timing control device according to claim 1, wherein the lock hydraulic pressure is set to be nearly equal to or lower than a hydraulic pressure generating a torque generated in the device, the torque being equal to a cam-torque during internal-combustion.

3. A valve timing control device according to claim 1, wherein the first communication passage is formed at an end of the case in an axial direction of the case.

4. A valve timing control device according to claim 1, wherein the first communication passage is a branch of a hydraulic pressure supply passage of communicating the operational hydraulic pressure chamber to a release hydraulic pressure chamber.

5. A valve timing control device according to claim 1, wherein the cross sectional area of the second communication passage is set to be larger than that the cross sectional area allowing discharge of foreign materials.

6. A valve timing control device according to claim 1, wherein the driving force transmitting means is a chain, wherein the lock member moves in a radial direction of the device, and wherein a stopper is arranged at the outermost section of the device, the stopper of holding the push member in the backward pressure chamber and integrated with the second communication passage.

7. A valve timing control device according to claim 1, wherein the cross sectional area of the first communication passage is set to be larger than that of the second communication passage.

8. A valve timing control device according to claim 7, wherein the cross sectional area of the second communication passage is set to be larger than that the cross sectional area allowing discharge of foreign materials.

9. A valve timing control device according to claim 7, wherein the driving force transmitting means is a chain, wherein the lock member moves in a radial direction of the device, and wherein a stopper is arranged at the outermost of the device, the stopper of holding the push member in the backward pressure chamber and integrated with the second communication passage.

* * * * *